US006785912B1

(12) United States Patent
Julio

(10) Patent No.: US 6,785,912 B1
(45) Date of Patent: Sep. 7, 2004

(54) ION TOILET SEAT

(76) Inventor: Burt V. Julio, 1796 Sutter St., San Diego, CA (US) 92103

( * ) Notice: Subject to any disclaimer, the term of this patent is extended or adjusted under 35 U.S.C. 154(b) by 0 days.

(21) Appl. No.: 10/350,211

(22) Filed: Jan. 24, 2003

(51) Int. Cl.[7] ..... A47K 13/00
(52) U.S. Cl. ..... 4/237; 4/233; 4/661
(58) Field of Search ..... 4/234, 237, 661, 4/233

(56) References Cited

U.S. PATENT DOCUMENTS 6,350,417 B1 * 2/2002 Lau et al. ..... 422/186.04
2003/0108460 A1 * 6/2003 Andreev et al. ..... 422/186.07

FOREIGN PATENT DOCUMENTS

| | | |
|---|---|---|
| JP | 07247587 | * 9/1995 |
| JP | 06068122 | * 10/1995 |
| JP | 09064082 | * 9/1998 |

* cited by examiner

*Primary Examiner*—Charles E. Phillips
(74) *Attorney, Agent, or Firm*—Steven W. Webb

(57) ABSTRACT

An improved toilet seat is presented that uses an electric generator, powerable by batteries, to generate negative ions that are dispersed into the toilet bowl to achieve odor control. The seat is configured like a standard toilet seat and is designed to be low-cost.

4 Claims, 5 Drawing Sheets

ION TOILET SEAT

BACKGROUND OF THE INVENTION

This invention relates to sanitary systems, in particular, conventional flush and portable toilets.

BRIEF SUMMARY OF THE INVENTION

Toilets fall into two main categories: flush toilets that use water to carry away liquid and solid waste immediately and portable toilets, not connected directly to a sewage system, that store liquid and solid waste until they can be emptied into a sewer. This invention is an application that can be used for both categories of toilets and will improve toilet odor control for either type.

There are certain chemical toilet systems that use added chemicals to control odor and patented devices that use electrical energy to control biotic growth and odor. The present invention relies on generating negatively charged ions that descend into the toilet bowl to counteract the odor-carrying effect of positively charged ions associated with liquid and solid wastes. Positive and Negative Electric Charges—A neutral atom or group of atoms becomes ionized by gaining or losing one or more electrons. The charge of an ion is always expressed as a whole number of unit charges and is either positive or negative. A simple ion consists of only one charged atom; a complex ion consists of an aggregate of atoms with a net charge. If an atom or group loses electrons it will have a net positive charge and is called a cation. If an atom or group gains electrons, it will have a net negative charge and is called an anion.

Since ordinary matter is electrically neutral, ions normally exist as groups of cations and anions such that the sum total of positive and negative charges is zero. Cations can be formed from a metal by oxidation (see oxidation and reduction), from a neutral base (see acids and bases) by protonation, or from a polar compound by ionization. Anions can be formed from nonmetals by reduction (see oxidation and reduction) or from neutral acids (see acids and bases) or polar compounds by ionization.

Oxidation and Reduction—complementary chemical reactions characterized by the loss or gain, respectively, of one or more electrons by an atom or molecule. Originally the term oxidation was used to refer to a reaction in which oxygen combined with an element or compound, e.g., the reaction of magnesium with oxygen to form magnesium oxide or the combination of carbon monoxide with oxygen to form carbon dioxide. Similarly, reduction referred to a decrease in the amount of oxygen in a substance or its complete removal, e.g., the reaction of cupric oxide and hydrogen to form copper and water.

When an atom or molecule combines with oxygen, it tends to give up electrons to the oxygen in forming a chemical bond. Similarly, when it loses oxygen, it tends to gain electrons. Such changes are now described in terms of changes in the oxidation number, or oxidation state, of the atom or molecule. Thus oxidation has come to be defined as a loss of electrons or an increase in oxidation number, while reduction is defined as a gain of electrons or a decrease in oxidation number, whether or not oxygen itself is actually involved in the reaction.

Oxidation-reduction reactions, called also redox reactions, are most simply balanced in the form of chemical equations by arranging the quantities of the substances involved so that the number of electrons lost by one substance is equaled by the number gained by another substance. In such reactions, the substance losing electrons (undergoing oxidation) is said to be an electron donor, or reductants, since its lost electrons are given to and reduce the other substance. Conversely, the substance that is gaining electrons (undergoing reduction) is said to be an electron acceptor, or oxidant. Ionization of Neutral Atoms—Ionization can also be caused by the bombardment of matter with high-speed particles or other radiation. Ultraviolet radiation and low-energy X-rays excite molecules in the upper atmosphere sufficiently to cause them to lose electrons and become ionized, giving rise to several different layers of ions in the earth's atmosphere. A gas can be ionized by passing an electron current through it; the ionized gas then permits the passage of a much higher current. Heating to high temperatures also ionizes substances; certain salts yield ions in their melts as they do in solution.

Negatively-charged negative ions attach themselves to contaminates and allergens, which are positively-charged. The newly-formed larger particles fall to the ground, and out of the air we breathe. Applications of Ionization—Ionization has many applications. In ion-exchange reactions, a specially prepared insoluble resin with attached dissociable ions is packed into a column. When a solution is passed through the column, ions from the solution are exchanged with ions on the resin. Water softeners use the mineral zeolite, a natural ion-exchange resin; sodium ions from the zeolite are exchanged for metal ions from the insoluble salt that makes the water hard, converting it to a soluble salt.

Odor-carrying gases include hydrogen, which is a natural by-product of bacterial action. By dousing positively-charged hydrogen gas generated within a toilet with a negatively charged gas, odor control can be improved.

In a generator that produces negatively-charged ions, the main circuit is high-voltage, either ac or dc. The high-voltage lead of this device is connected to a high-voltage diode, which permits a negative voltage to pass to a small capacitor bank. This negative high voltage is then connected to a conductive object that has or comes to a sharp point. The sharp point enhances the discharge of negative ions into the surrounding atmosphere.

The advantages of mixing negatively-charged ions with the gases in a toilet bowl will be readily apparent by referring to the detailed description that follows, accompanied by the drawings.

SUMMARY OF THE INVENTION

It is an object of the present invention to provide an improved odor-control system for conventional and portable toilets.

It is a further object of the present invention to control said odors with electrical means, including battery-operated ion generation.

It is a further object of the present invention to make the invention compatible with existing toilet and toilet seat design.

It is a further object of the present invention to keep the cost to the consumer for this invention as low as possible.

BRIEF DESCRIPTION OF THE DRAWINGS

The construction and operation of the invention can be readily appreciated from inspection of the drawings that accompany this application, combined with the detailed specification to follow.

DETAILED DESCRIPTION OF THE INVENTION

Figure 1:
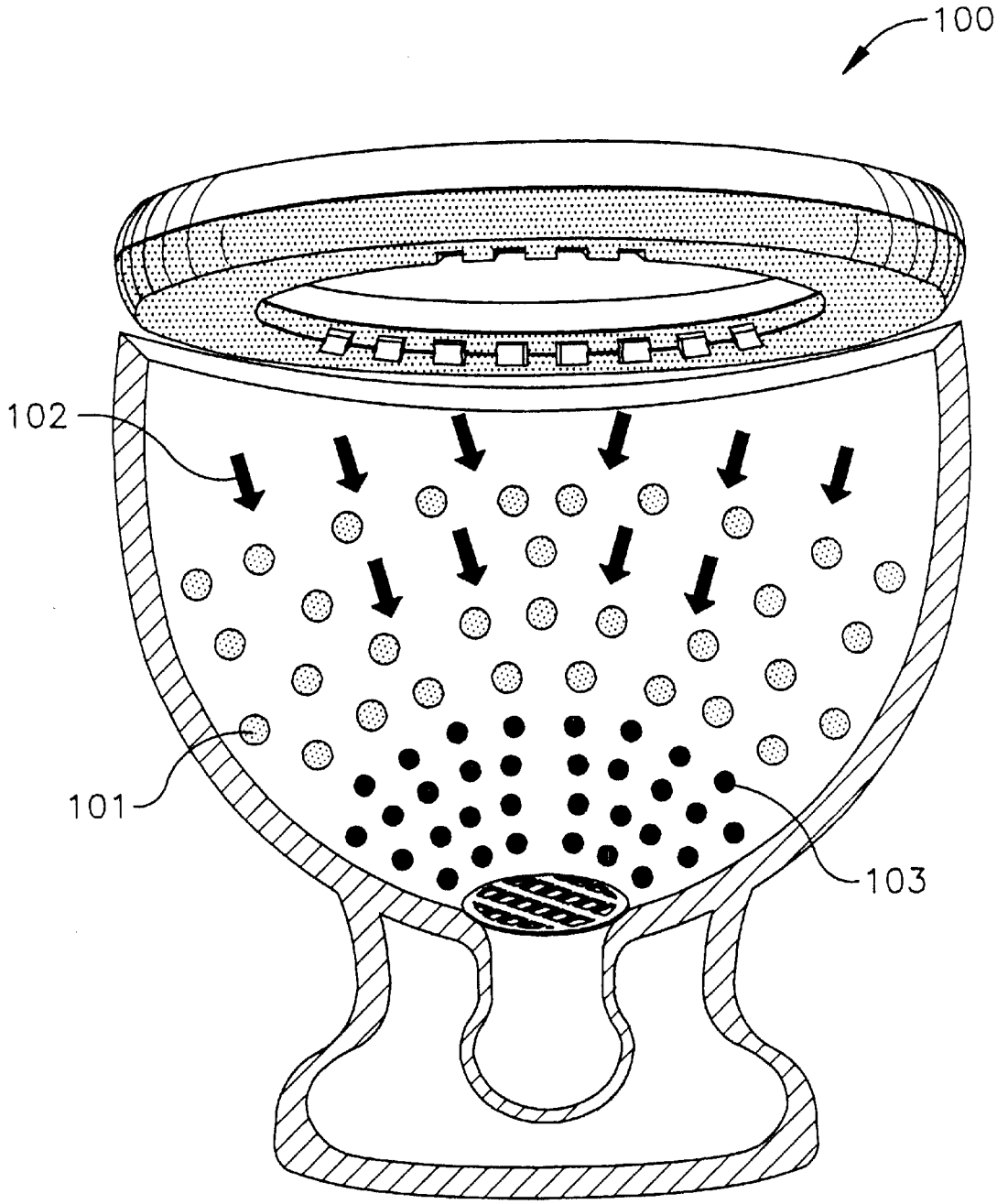
FIG. 1 is an overview diagram of the invention as used with a toilet
Figure 2:
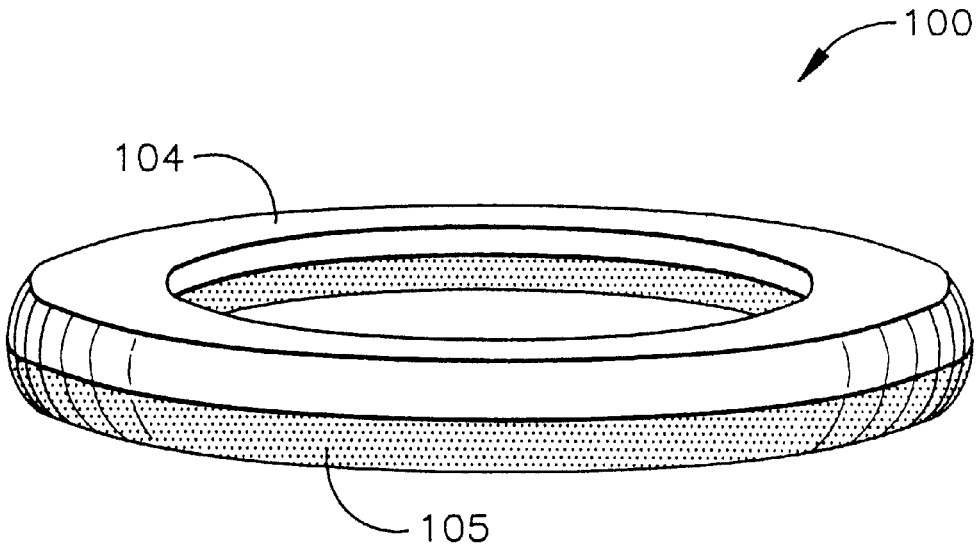
FIG. 2 is a perspective drawing of the invention

In FIG. 1, the size and shape of the ion toilet seat[100] can be seen. The dispersing negative ions of gas[102] descending into the toilet bowl[101] come into contact with the saturated, semi desaturated, and desaturated odor particles[103] rising from the odor source below. In FIG. 2., the separation of the ion toilet seat[100] into an upper casing[104] and an ion dispersement casing[105] is shown. The upper casing[104] and ion dispersement casing[105] are held together in a detachable manner, permitting repairs to be made to the internal components of the ion toilet seat[100].

Figure 3:
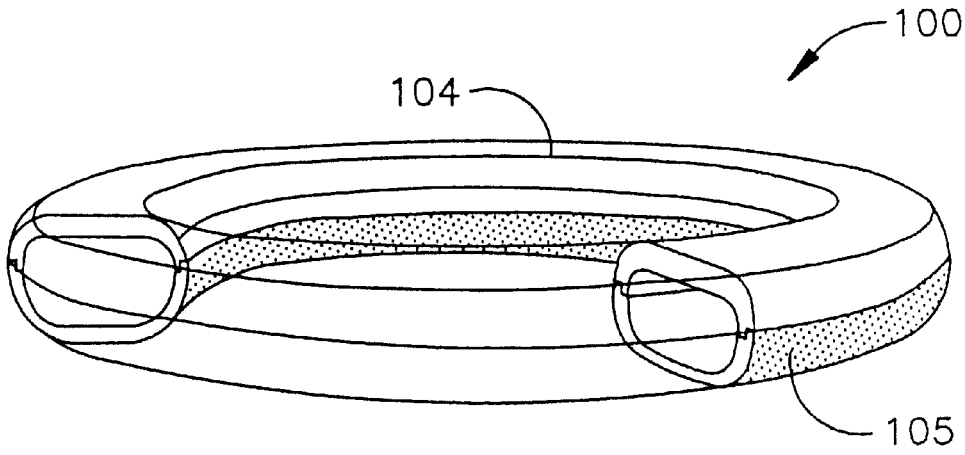
FIG. 3 is a cross-section drawing of the invention
Figure 4:
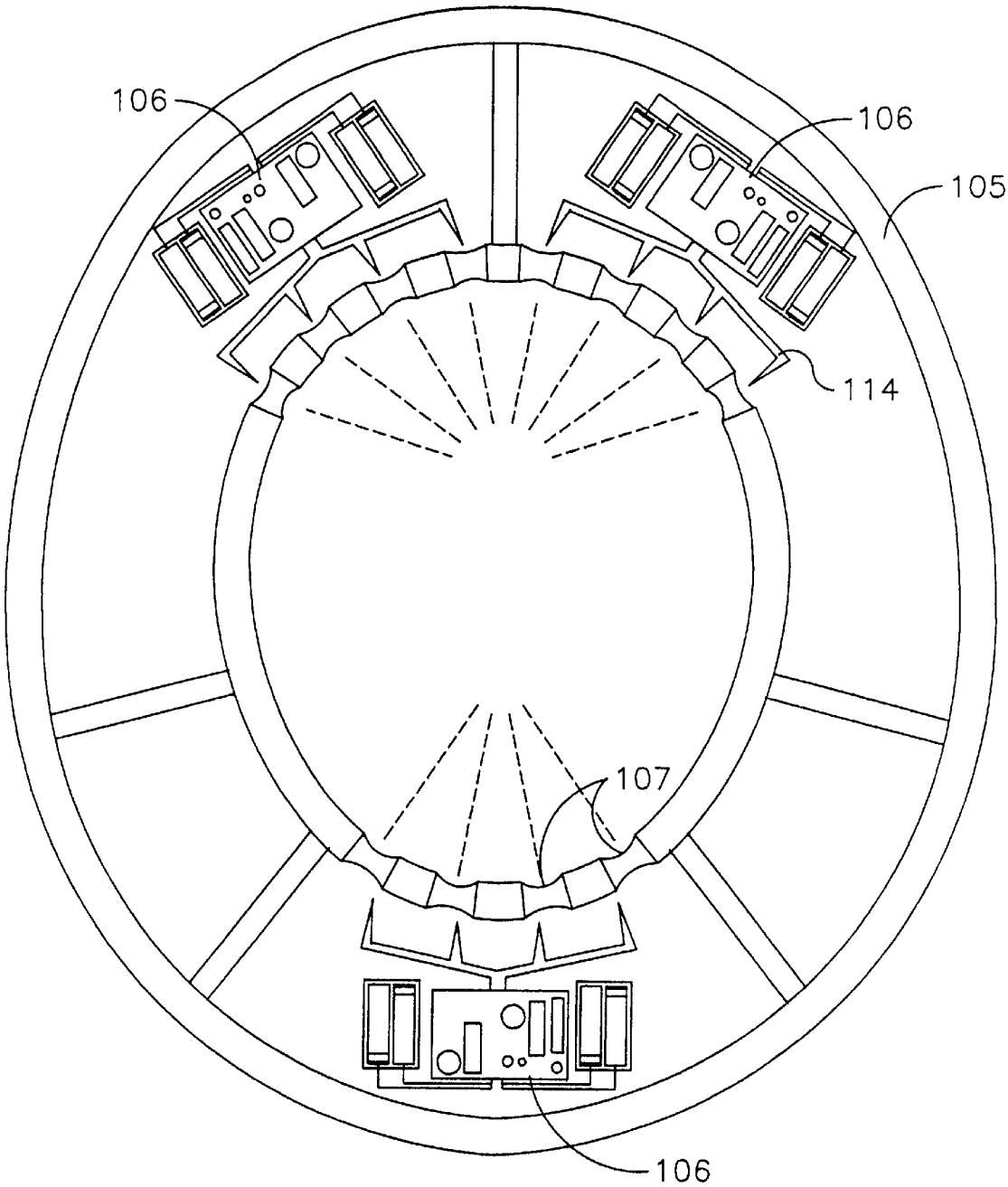
FIG. 4 is a top view of the interior of the invention

In FIG. 3. The hollow interior of the ion toilet seat is shown in cross-section. FIG. 4 shows the placement of the ion generators[106] in the preferred embodiment, a total of three generators[106]. The generators are mounted fixedly in the ion dispersement casing[105]. Ion distribution conduits[114] that fan out from the ion generators[106] to a plurality of holes[107] in the inner rim of the ion dispersement casing[105] are also shown.

Figure 5:
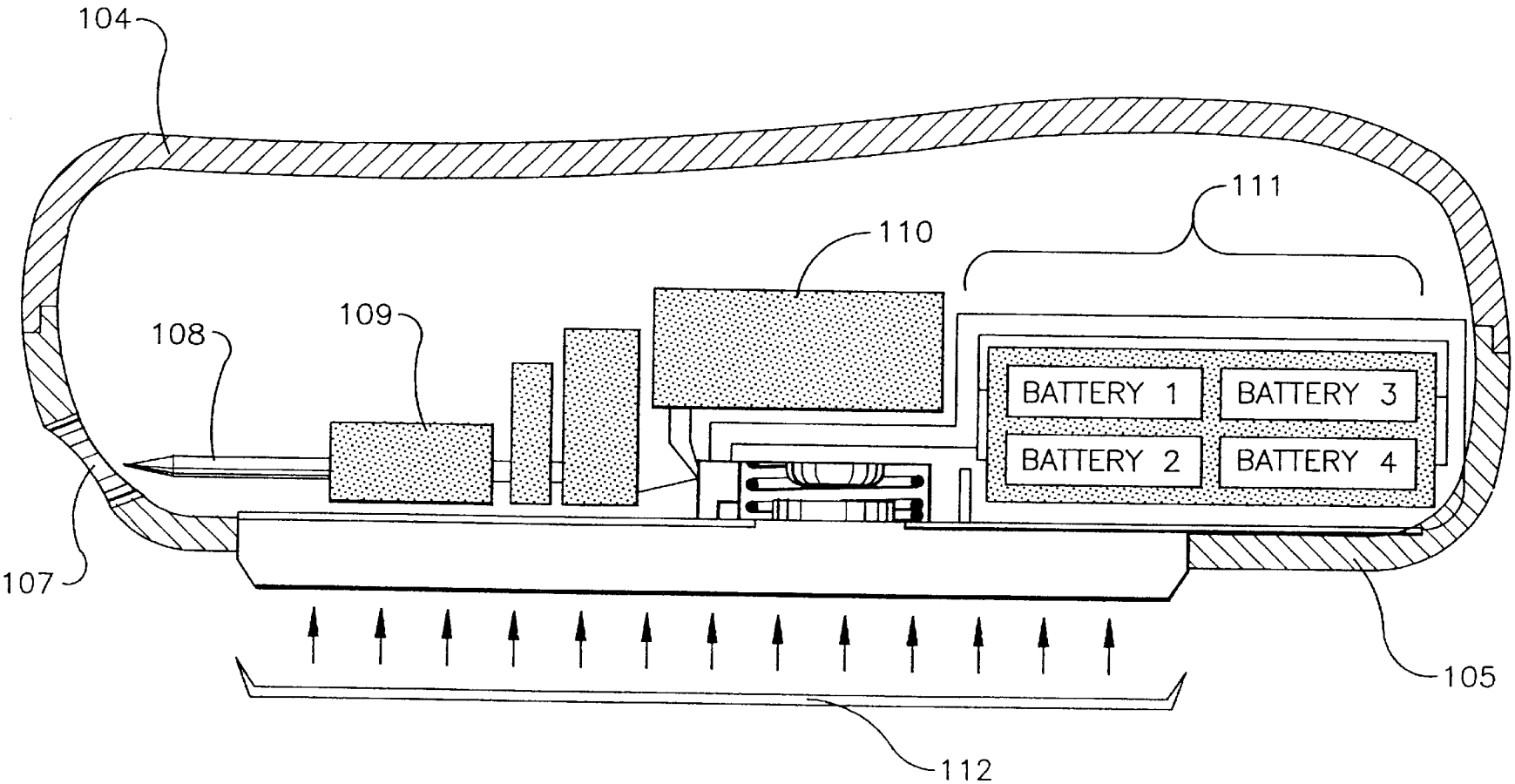
FIG. 5 is a cross section of the ion generator

In FIG. 5, the ion generators are shown in detail. The generators are comprised of a discharge needle[108], a capacitor bank[109], a high-voltage diode[110], a high-voltage power supply[111], and an activation pedal[112]. In the preferred embodiment, the high-voltage power supply[111] is a set of batteries.

Figure 6:
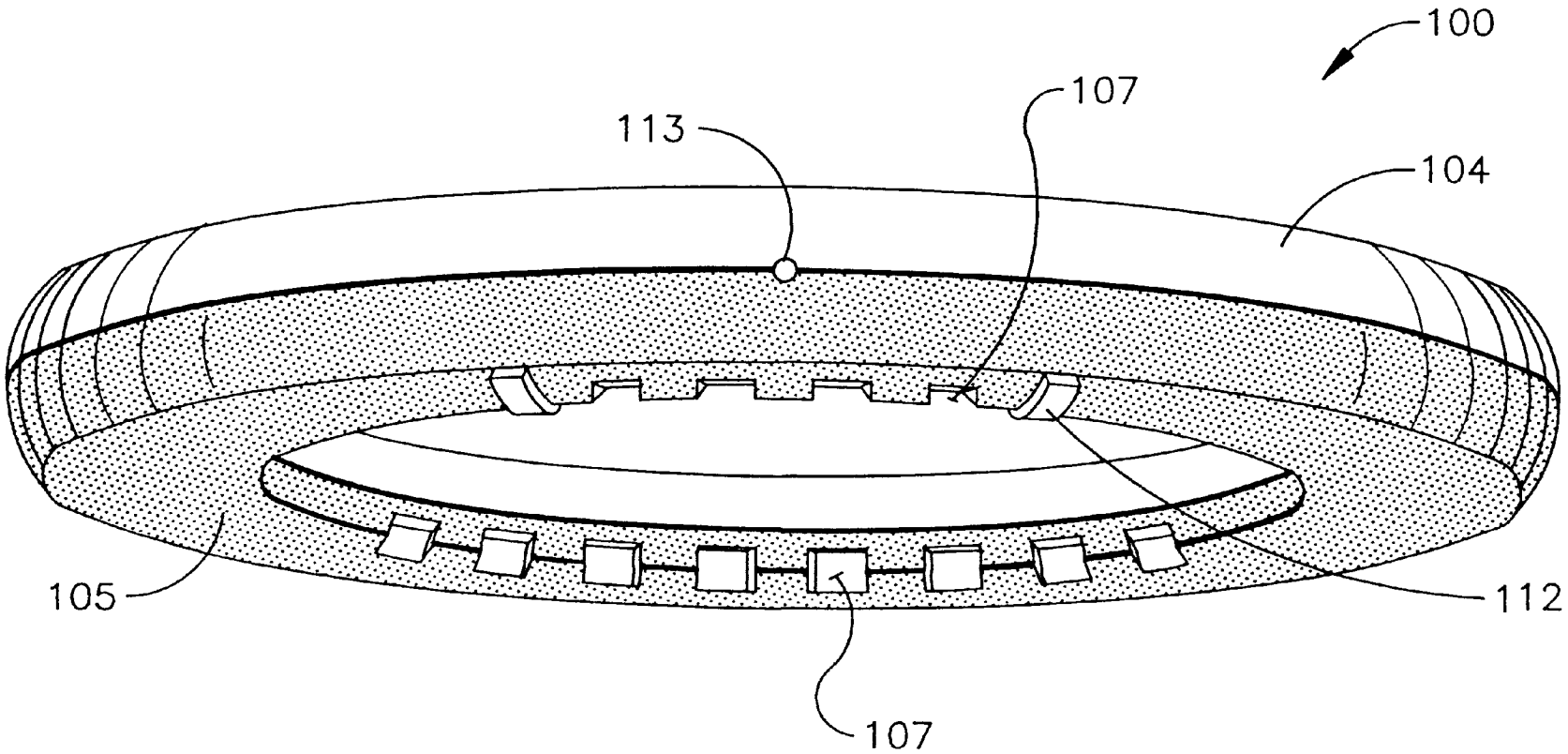
FIG. 6 is a perspective view of the underside of the invention

FIG. 6. shows a perspective view from the underside of the invention[100]. The dispersement holes[107] are set close to the locations of the generators[106]. The two activation feet[112] are placed at the front of the seat to be pressed by the seat occupant when desired.

While the foregoing describes a preferred embodiment of the invention, variation on this design and equivalent designs may be resorted to in the scope and spirit of the claimed invention.

What is claimed is:

1. A toilet seat that generates ionized gases for odor control, the toilet seat comprised of an upper casing and an ionic dispersement casing, the upper casing compatible with the upper surfaces of standard toilet seats, the ionic dispersement casing connected in a detachable manner to the upper casing, the ionic dispersement casing and upper casing forming a hollow torus, the ionic dispersement casing possessing an inner surface and an outer surface, the ionic dispersement casing outer surface compatible with the outer surfaces of standard toilet seats, the ionic casing outer surface penetrated at a plurality of points with dispersement holes, each of said dispersement holes connecting the ionic dispersement casing inner surface with the ionic dispersement casing outer surface, the ionic dispersement casing inner surface having a plurality of ion generators attached fixedly to it, the ion generators comprised of an ion motor, ion distribution conduits, a high-voltage power supply, an activation pedal, and an ion distribution conduit, the ion motor comprised of a discharge needle, a capacitor bank and a high-voltage diode, the activation pedal for each generator attached to the ionic dispersement casing outer surface, each of said activation pedals connected electrically to the associated ion generator.

2. The toilet seat of claim 1 where said high-voltage power supply is a set of batteries.

3. The toilet seat of claim 2 where said activation pedals are buttons that can be pressed by hand.

4. The toilet seat of claim 1 where there are three ion generators placed on the ionic dispersement casing inner surface.

* * * * *